US006978753B2

(12) United States Patent
Augustus et al.

(10) Patent No.: US 6,978,753 B2
(45) Date of Patent: Dec. 27, 2005

(54) AUTOMATED COMBUSTION CHAMBER DECARBONING SQUID

(75) Inventors: Richard Augustus, Wichita, KS (US); Harold E. Erwin, Augusta, KS (US); Abram Bennett Kuipers, Derby, KS (US)

(73) Assignee: BG Products, Inc., Wichita, KS (US)

( * ) Notice: Subject to any disclaimer, the term of this patent is extended or adjusted under 35 U.S.C. 154(b) by 247 days.

(21) Appl. No.: 10/388,035

(22) Filed: Mar. 12, 2003

(65) Prior Publication Data

US 2003/0178000 A1 Sep. 25, 2003

Related U.S. Application Data

(63) Continuation-in-part of application No. 09/952,792, filed on Sep. 14, 2001, now Pat. No. 6,557,517.

(51) Int. Cl.[7] ..... F02N 11/08
(52) U.S. Cl. ..... 123/179.3; 123/179.4
(58) Field of Search ..... 123/179.3, 179.4, 123/198 E, 198 R

(56) References Cited

U.S. PATENT DOCUMENTS

| | | | | |
|---|---|---|---|---|
| 3,797,507 | A | 3/1974 | Jackson | |
| 4,197,140 | A | 4/1980 | Swan | |
| 4,784,170 | A | 11/1988 | Romanelli et al. | |
| 4,877,043 | A | 10/1989 | Carmichael et al. | |
| 5,063,896 | A | 11/1991 | Hyatt et al. | |
| 5,349,931 | A * | 9/1994 | Gottlieb et al. | 123/179.2 |
| 5,826,602 | A | 10/1998 | Chen | |
| 5,858,942 | A | 1/1999 | Adams et al. | |
| 5,901,719 | A | 5/1999 | Martinez | |
| 6,178,944 | B1 | 1/2001 | Kerns et al. | |
| 6,456,034 | B1 * | 9/2002 | Vilou | 318/811 |
| 6,561,151 | B1 * | 5/2003 | Wisnia et al. | 123/179.2 |
| 6,634,332 | B2 * | 10/2003 | Saito et al. | 123/179.3 |
| 6,640,763 | B2 * | 11/2003 | Kawakami et al. | 123/179.3 |
| 6,672,268 | B2 * | 1/2004 | Ogawa et al. | 123/179.3 |
| 6,722,334 | B2 * | 4/2004 | Streng | 123/179.3 |
| 6,725,821 | B2 * | 4/2004 | Warren et al. | 123/179.3 |
| 6,752,111 | B2 * | 6/2004 | Osada et al. | 123/179.3 |
| 6,807,934 | B2 * | 10/2004 | Kataoka et al. | 123/179.4 |
| 6,817,329 | B2 * | 11/2004 | Buglione et al. | 123/179.4 |

* cited by examiner

*Primary Examiner*—Henry C. Yuen
*Assistant Examiner*—Jason Benton
(74) *Attorney, Agent, or Firm*—Shook, Hardy & Bacon L.L.P.

(57) ABSTRACT

A device for and method of decarboning a combustion chamber and compression rings in an internal combustion engine. The device is a squid shaped container with a cylindrical body, a screw cap, and conduits depending from the body for transmitting cleaner to the combustion chambers on the engine. Once cleaner is transmitted to the combustion chambers, the engine is bumped to work the fluid into the compression rings using an automated system with a timer. When the engine is bumped, the device allows the cleaner to be vented to the device to avoid hydrolocking the engine. The device also contains the cleaner so that it is not splashed outside the engine.

9 Claims, 3 Drawing Sheets

AUTOMATED COMBUSTION CHAMBER DECARBONING SQUID

CROSS REFERENCE TO RELATED APPLICATIONS

This application is a continuation-in-part of and claims priority from non-provisional application Ser. No. 09/952,792 filed Sep. 14, 2001 now U.S. Pat. No. 6,557,517, the contents of which are herein incorporating by reference.

STATEMENT REGARDING FEDERALLY SPONSORED RESEARCH OR DEVELOPMENT

Not applicable.

BACKGROUND OF THE INVENTION

The present invention relates to the decarboning of the combustion chamber of an internal combustion engine using a liquid cleaner. More specifically, the present invention relates to the cleaning of the compression rings on the piston associated with the combustion chamber.

The typical internal combustion engine has at least one combustion chamber associated with a piston. On the piston are a pair of compression rings. The compression rings serve to prevent the escape of gases from the chamber around the sides of the piston during the compression stroke of the engine.

The only known method of effectively cleaning compression rings is to overhaul the engine. Overhauling involves dismantling the engine, cleaning any carbon coated parts, putting in new rings, and then reassembling. It is extremely costly and time consuming. Further, some modern engines (i.e., the Cadillac Northstar®) cannot be overhauled because of the way they are constructed. Because they cannot be overhauled, carbon buildup on the compression rings in these kinds of engines is a major concern. If the buildup on the rings becomes so great that compression within the combustion chamber unacceptable, the engine must be replaced. This has resulted in these modern engines earning the nickname "throw-away engines."

Even though overhauling is the only effective prior art method for cleaning the compression rings, liquid cleaners have been used to clean combustion chambers in the past. One such method involves manually pouring an alcohol based cleaner into the combustion chamber after removing the spark plug and leaving the spark plug hole open.

This method has at least three disadvantages. First, alcohol based products tend to cause the carbon deposits to break off rather than dissolve. When carbon deposits break off between the piston rings, they become trapped. These trapped particles can cause engine problems.

Second, the open spark plug hole does not allow the user to activate the pistons during the cleaning to work the cleaner into and between the compression rings in an effective manner. If the user were to activate the pistons under this prior art method, the cleaner would splash out of the open spark plug hole. Splashed engine cleaners can eat away at external parts of the engine causing irreparable damage. Splash can be prevented by capping the spark plug hole after the cleaner has been poured in. However, capping the hole also precludes the mechanic from activating the pistons while cleaner is in the chamber. The cleaner can become trapped when the piston is in the upper range of its motion in the chamber because it cannot escape out the spark plug hole. The trapped fluid is not compressible (as is air), so the back pressure resists the movement of the piston so that the engine will not turn over. This is called "hydrolocking." Hydrolocking an engine can cause tremendous damage to the engine's pistons and rods.

Third, the liquid cleaners are not able to effectively clean contaminants present on the upper components of the combustion chamber, such as the valves. This is because the level of liquid cleaner within the chamber must be low enough to avoid splashing out.

SUMMARY OF THE INVENTION

It is therefore an objective of the present invention to provide a clean and simple method of inducing and maintaining cleaner in the combustion chamber during the cleaning process and an apparatus for enabling such.

It is a further objective of the present invention to provide a way of maintaining cleaning fluid in the combustion chamber at the same time as activating the piston that prevents fluid from being spilled onto other engine components or hydrolocking the engine.

It is a further objective of the present invention to provide a way of immersing contaminants in the upper parts of the combustion chamber to cleaner.

It is yet another objective of the present invention to provide a pressurized blowout procedure whereby fluid is forced through the exhaust system of the vehicle after cleaning by way of the application of pressurized air.

These objectives are accomplished using a new device. The device resembles and is hereinafter referred to as a "squid." The squid has a cylindrical body with sub-cavities into which cleaner is poured. Each sub-cavity is associated with a conduit which is used to deliver the cleaner to a particular combustion chamber in an engine. Each conduit is connected to an adapter that screws into the engine block of the vehicle being serviced. The adapters are easily screwed into the spark plug opening in the combustion chamber after removing the spark plug.

The squid enables the user to clean the compression rings of the piston without overhauling the engine. Clean piston rings are essential for maintaining ideal compression ratios within the combustion chamber. The loss of compression within the combustion chamber is caused by a principle called blow-by. The build up of carbon deposits on the compression rings can cause these rings to not sit flush against the cylinder walls. This creates small gaps between the compression ring and the cylinder wall. These gaps cause the compressed air in the combustion chamber to inappropriately blow past the compression rings downwardly past the piston. This lowers engine compression ratios. Poor compression ratios can greatly reduce performance, increase harmful emissions and even completely disable an engine. Also, engine oil can enter the combustion chamber where it is burned and consumed, creating more deposits and increasing engine oil consumption.

The present invention is the only known solution to blow-by problems in a combustion chamber without overhauling the engine.

BRIEF DESCRIPTION OF THE DRAWINGS

The accompanying drawings form part of the specification and are to read in conjunction therewith. Reference numerals are used to indicate like parts in the various figures.

DESCRIPTION OF THE PREFERRED EMBODIMENT

Figure 3:
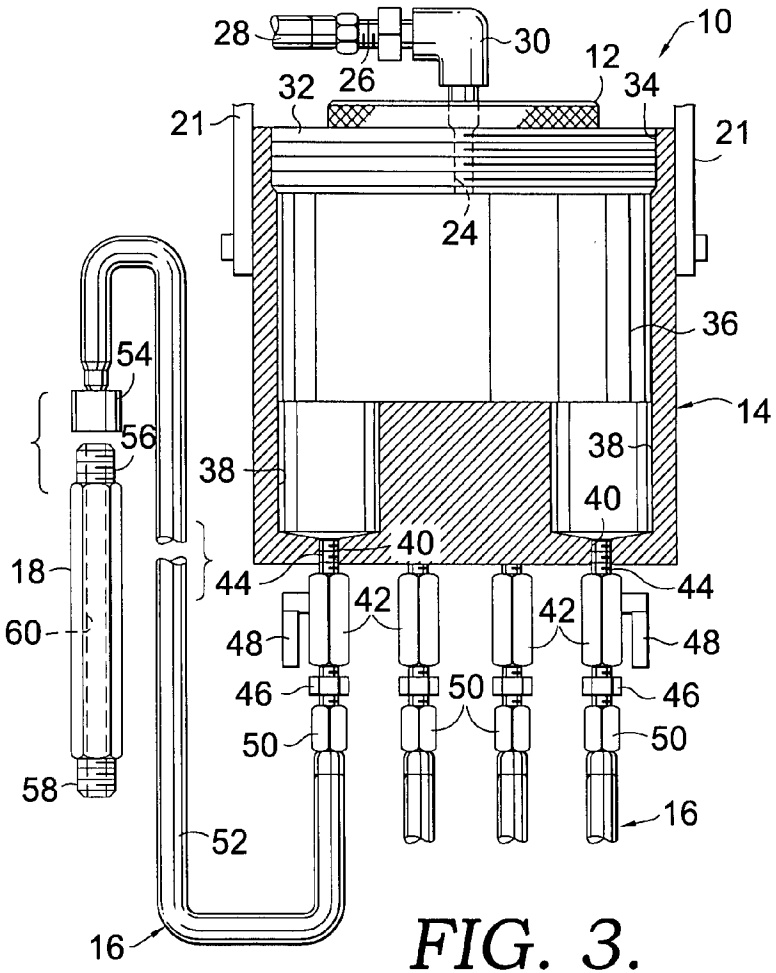
FIG. 3 is an exploded cross-sectional view at section 3—3 in FIG. 2 and also depicting the adaptor of the present invention.
Figure 1:
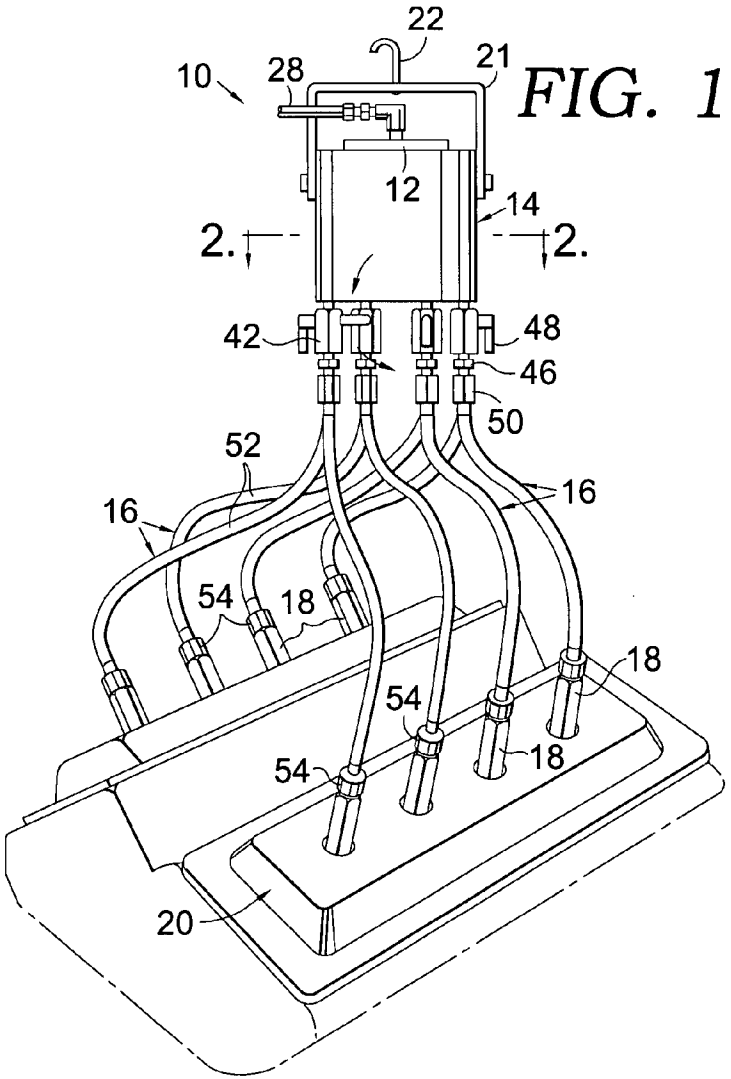
FIG. 1 is a fragmented perspective view of the squid in use on a vehicle with an eight-cylinder engine.
Figure 2:
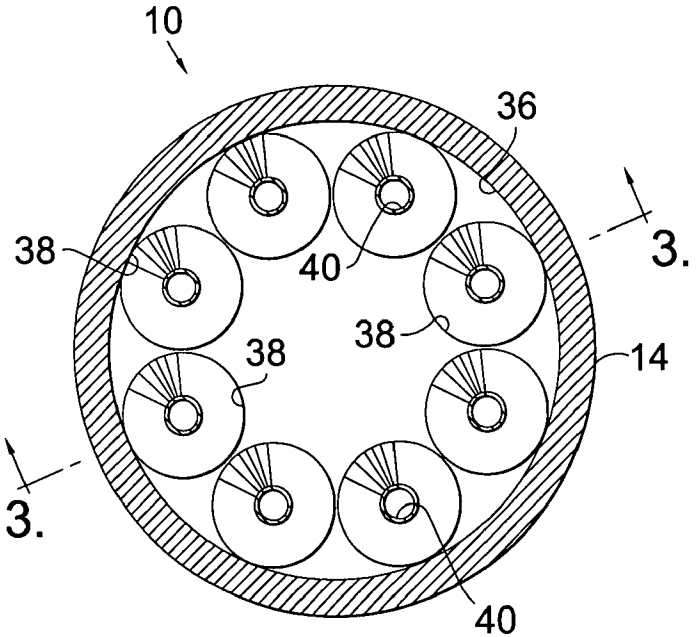
FIG. 2 is a cross-sectional view at section 2—2 in FIG. 1 from above.

The present invention solves the prior art problems noted above by creating a cleaning fluid distributing and maintaining squid 10 shown in FIGS. 1–3. The more general aspects of the invention can be observed in FIG. 1. The squid ring decarbonater 10 has four primary components: (i) a screw cap 12, (ii) a cylindrical body 14, (iii) a plurality of conduits 16, and (iv) a plurality of spark plug adaptors 18. Adaptors 18 are used to deliver cleaning fluid to an internal combustion engine 20 (see FIG. 4).

A suspension hook 22 is used to hang squid 10 from the open hood of the vehicle being serviced (not pictured) and is connected to body 14 by a bracket 23.

Body 14 is sealed at its upper end when screw cap 12 is screwed on. Screw cap 12 is used to seal off the top of body 14. The specific details of cap 12 can best be seen in FIG. 3. FIG. 3 shows that pressurized air can be delivered through cap 12 into the cylindrical body 14 by way of a cylindrical bore 24. A snap-on connector 26 is used to connect to a pressurized air hose 28. When connected, pressurized air travels from the pressurized air hose 28 through the snap on connector 26 through an elbow 30 down through the bore 24 and into body 14. Cap 12 is secured by engaging a set of male threads 32 on cap 12 with a set of female threads 34 on body 14.

As can be seen in FIGS. 2 and 3, body 14 is bored out to create a main cylinder cavity 36. Bored out below main cylinder cavity 36 are a plurality of sub-cavities 38 which receive and hold cleaning fluid. Also part of body 14 are a plurality of threaded openings 40 which are used to receive mating threads 44 on each of a plurality of conduits 16.

These conduits 16 are valved. The valves 42 on each conduit 16 have upper threads 44 and lower threads 46. Each valve 42 is opened or shut using a valve control lever 48. The valves themselves 42 may be common ball valves or any other type of valve known in the art capable of optionally opening up or shutting off flow. The upper threads 44 are used to mesh with the threaded openings 40 on the bottom of the cylindrical body 14 to secure the conduit 16 thereto and permit flow into the conduit from the main body. The lower threads 46 on the valve are received by threads on a first threaded connector that is connected to a translucent tubing 52. Translucent tubing 52 should be constructed of nylon material capable of withstanding the chemicals transmitted through it. At the other end of the translucent tubing 52 is a second threaded connector 54. The second threaded connector 54 is used to attach the spark plug adaptor 18.

The spark plug adaptor 18 has a set of upper end threads 56 which are used to mate with the second threaded connector 54 of the conduit 16. The adaptor 18 also has a set of header engaging threads 56 which are of the same pitch and size as the threads on an ordinary spark plug. The adaptor 18 is essentially a hollow tube which defines a metered compression rate controlling passageway 60. Passageway 60 is used to control the compression rate through the adaptor 18 and conduit 16 during back flow of fluid through the system. This is done by boring passageway to a diameter that allows a limited amount of forced flow there through.

Figure 4:
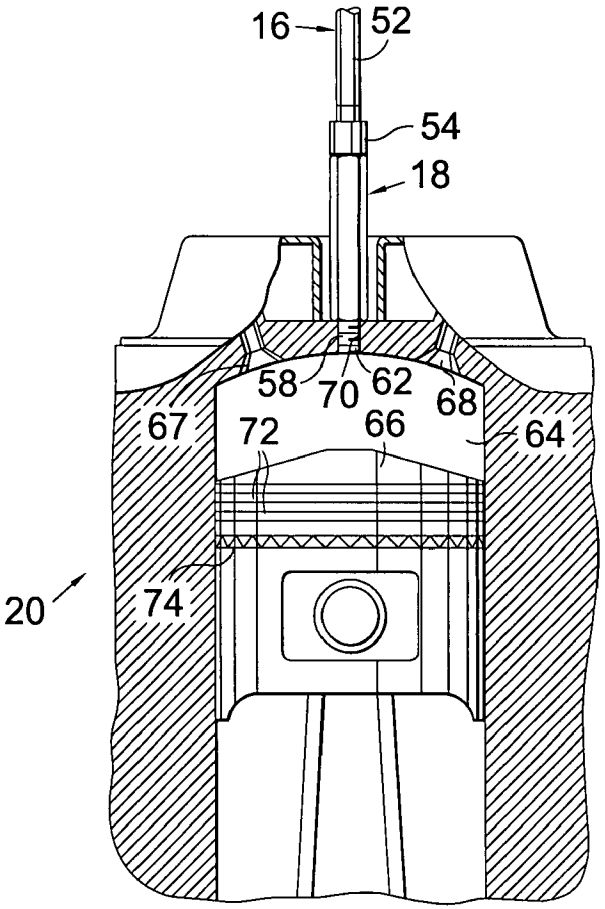
FIG. 4 shows a combustion chamber arrangement within a typical internal combustion engine with an adapter attached.

As can be seen in FIG. 4, the spark plug receiving threads 62 on the spark plug holes 70 on the vehicle's header 20 are used to receive header engaging threads 58 on the adaptor 18. This connects the adaptor 18 to the header 62 allowing the passage of fluid into the engine's combustion chamber 64. The combustion chamber 64 is sealed at its lower end by a piston head 66. At the top of the combustion chamber 64 are intake 67 and exhaust 68 valves and spark plug opening 70. The typical piston head 66 has a pair of compression rings 72 at its upper end which are used to compressibly seal off the combustion chamber 64 from below. A single oil ring 74 is used to seal off the combustion chamber from the seepage up of oil from below during suction stroke of engine 20.

The squid decorboning process has four steps. First, squid 10 must be filled with cleaner. Second, squid 10 is used to transmit the cleaner from the squid to fill the combustion chambers on the vehicle being serviced. Third, the engine is "bumped" in order to work the cleaner into the compression rings. Finally, the cleaner is blown out of the combustion chamber under pressure administered by the squid. Before beginning the decarboning process, engine 20 should be brought up to operating temperature (usually 195 to 200 degrees) so that the carbon deposits become softer. This makes them easier to be cleaned. It's also very important to disable the ignition coils to prevent electrical damage to the ignition system.

With respect to the first step of filling the squid, Cap 12 should be removed from the body 14 to expose main cavity 36 and eight sub-cavities 38. The user should make sure that all of the valves 42 are closed. Next, each of the spark plugs on the engine 20 should be removed and replaced with adapters 18. (See FIG. 4). Adapters 18 are attached by screwing header engaging threads 58 into each threaded spark plug opening 70 for combustion chamber 64 on engine 20. As can be seen in FIG. 3, conduits 16 should then be secured to the conduit end threads 56 on each of the adaptors 18 that have been secured to the engine 20. It is apparent that with engines with fewer than eight cylinders, some conduits 16 will be left over after all of the adaptors 18 have been hooked up to a conduit 16. These left over conduits 16 will remain idle during the cleaning process. As can best be seen from FIG. 3, each conduit 16 is associated with a particular sub-cavity 38. Next, sub-cavities 38 should be filled with cleaner.

The preferred cleaner of the present invention is a solvent offered by BG Products, Inc. located in Wichita, Kans. and sold under the name BG 211 Induction System Cleaning, BG Part 211. The composition of the solvent is readily ascertainable from the label of the product. This solvent is preferred over the alcohol based solvents used in the prior art methods described above because it dissolves the carbon particles rather than breaking them off. As described in the background section above, carbon particles can be problematic when they are trapped between the compression rings of a piston. While this BG 211 solvent is the preferred solvent of the system, it is to be understood that other solvents capable of dissolving carbon deposits may also be used and are within the scope of the present invention.

Only the sub-cavities 38 that are associated with attached conduits 16 should be filled. The sub-cavities 38 that are associated with idle conduits 16 should not. After filling the appropriate sub-cavities 38, cap 12 should be screwed on to body 14. The hood of the vehicle to be serviced (not pictured) should be opened up and suspension hook 22 used to hang the squid 10 from the hood. The underside of a typical car hood has an opening near the hood latch that can be used to receive the hook 22. Once hung, squid 10 is ready to fill the combustion chambers with cleaner.

To fill the combustion chambers with cleaner, the valve control levers 48 on each of the hooked up conduits 16 should be turned to open position. This means that for an eight cylinder engines all eight will be opened up. However, for a smaller engine, such as a four-cylinder, only four of the valves would be opened up and the remaining four would remain closed. Once the appropriate valves 42 have been opened up, the cleaning solution will run down the conduits 16 through the metered compression rate controlling passageway 60 into the combustion chamber 64 of the engine 20. The valves 42 should remain open during the steps that follow.

The third step involves bumping the engine. Bumping means that the user will briefly turn the ignition starter so that the pistons move up and down only a couple of inches. Since the cleaner is now in the combustion chambers 64, the cleaner will be massaged into the rings. This bumping process is impossible with any of the prior art methods. As explained in the background section, the prior art methods involved either capping or uncapping opening 70. Capping opening 70 while bumping the engine 20 results in hydrolocking the engine when the piston is in its up-stroke. Leaving opening 70 uncapped while bumping causes cleaner to spew out chamber 64 onto outside engine components causing them to decompose if they are susceptible to the harsh chemicals in most cleaners. Additionally, these prior art cleaners will not effectively clean the contaminants in the upper areas of the combustion chamber because the cleaner level in the chamber must be maintained so low as to not splash out of the chamber when the piston is at the top of its range of motion.

These prior art dilemmas have been overcome by the squid 10. When the piston is in its up-stroke, squid 10 allows the cleaner to be vented up into the metered portion 60 of the adaptor 18 (see FIG. 3) and through the conduit 16 back up into the body 14. The metered section 60 of the adaptor 18 serves to control the pressurization rate of the fluid such that it can be safely delivered through the conduit 16 up into its respective sub-cavity 38. The squid acts as a vent releasing the cleaner from the combustion chamber, while at the same time safely containing it. This prevents any damage to the piston or rods that could be caused by hydrolocking the engine and also immerses the contaminants in the upper portions of the chamber (i.e., the valves) in cleaner.

On the down-stroke of piston 66, however, the fluid will be drawn back down out of the sub-cavity 38 through the conduit 16 into adaptor 18 and back into chamber 64. The cleaner moves in and out of the chamber 64 consonant with piston 66 position during bumping.

The bumping process works cleaner into the compression rings 72 thoroughly. This causes the carbon deposits on rings 72 to dissolve into the cleaner. The engine 20 should be bumped several times for optimal results. The user should ideally wait 15 minutes between each bumping in order to allow the cleaner to gradually dissolve the carbon deposits on the compression rings 72. After the bumping process has been repeated every 15 minutes for the desired amount of time (usually 2 hours), it is time to blow out the cleaner.

The blowing out process is accomplished by attaching a pressurized air source 28 onto snap on connector 26. Engine 20 should then be turned over continuously for 30 to 60 seconds while user observes the translucent tubes 52 for the presence of cleaner. The pressurized air from the hose 28 forces the cleaner from the sub-cavities 38 down through conduits 16 through adaptors 18 into combustion chambers 64 and then out the exhaust valves 68 of the engine 20 and then out the vehicle's exhaust system. Once tubes 52 are clear of cleaner, the user should continue turning the engine over under pressure for another 15 seconds. The pressure should be turned off. This completes the blow out process, and the combustion chamber should now be clean.

This four step process of (i) filling the squid with cleaner, (ii) transmitting the cleaner from the squid to the combustion chambers, (iii) bumping the engine, and (iv) blow out may be repeated any number of times if the contamination in the combustion chamber so requires.

Upon completion of these cleaning processes, the valves 42 should be closed, and adaptors 18 unscrewed and removed from spark plug holes 70. New spark plugs should then be screwed into spark plug holes 70. The disconnected ignition coils should also be reconnected. It is also important to note that the engine oil system should be chemically flushed within one hour of the completion of the squid service. This is done to remove any chemical and/or carbon deposits that may have reached the oil pan below the cleaned piston. The vehicle should never be allowed to sit overnight before performing such an oil flush because any cleaner within the fluid can damage components of the engine.

The removal of carbon deposits from the compression rings restores compression to the cylinders lost due to the buildup of carbon deposits. The effectiveness of compression restoration can be determined by performing a compression check on each cylinder after the cleaning. Besides the compression rings, the squid service also removes carbon deposits from the combustion chamber and valves. Oil ring 74 has been cleanable under prior art methods of power flushing oil systems. However, the squid of the present invention enables the cleaning of compression rings 72 without completely overhauling the engine—an impossibility prior to the present invention. The fact that oil ring 74 could be cleaned by prior art methods was of little significance before this invention because such cleaning would not improve engine performance because of the unremovable buildup of carbon deposits on the compression rings. Now that compression rings 72 can be cleaned along with the oil ring 74, combined cleaning restores overall compression in the combustion chamber 64 with unprecedented effectiveness. This makes squid 10 an important tool in overcoming compression problems caused by carbon deposits on compression rings. This is especially true for modern engines such as the Cadillac Northstar® that cannot be overhauled. The squid essentially saves the mechanic from having to throw out the engine when carbon deposits cause compression ratios to become unacceptably poor. Now the mechanic can restore compression by merely servicing the engine with cleaner.

In another embodiment, a Starter Control Device (the "SCD"), when combined with the existing squid 10, automates the decarboning process. Automation of the decarboning process alleviates the need for the user to periodically "bump" or crank the engine at specific intervals. The invention also "bumps" the engine by engaging the vehicles starter without turning on the ignition, thus eliminating the need to disable the engines ignition coils.

Figure 5:
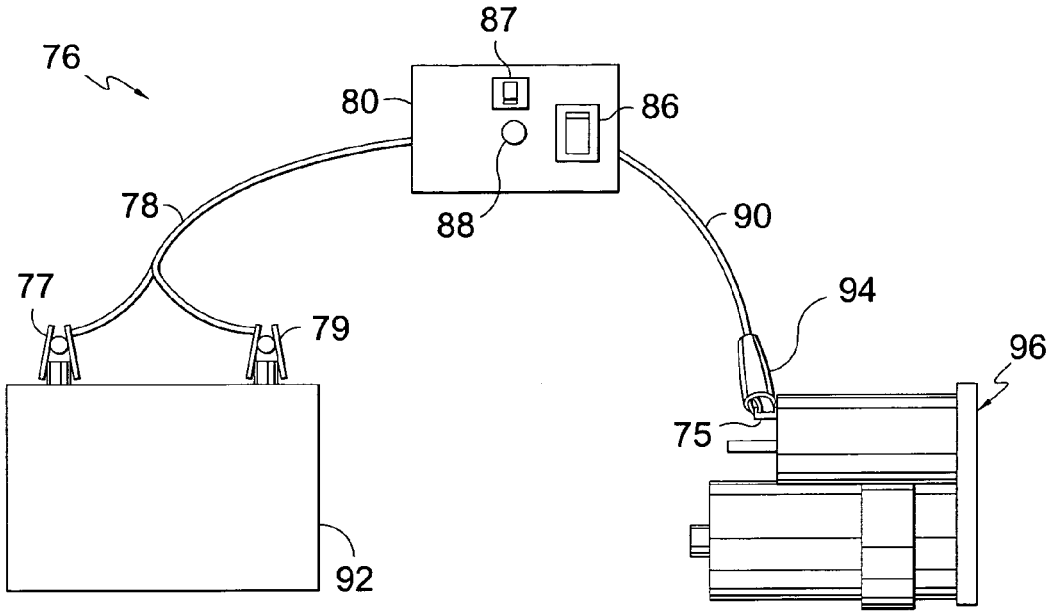
FIG. 5 shows the automated system of the present invention.
Figure 6:
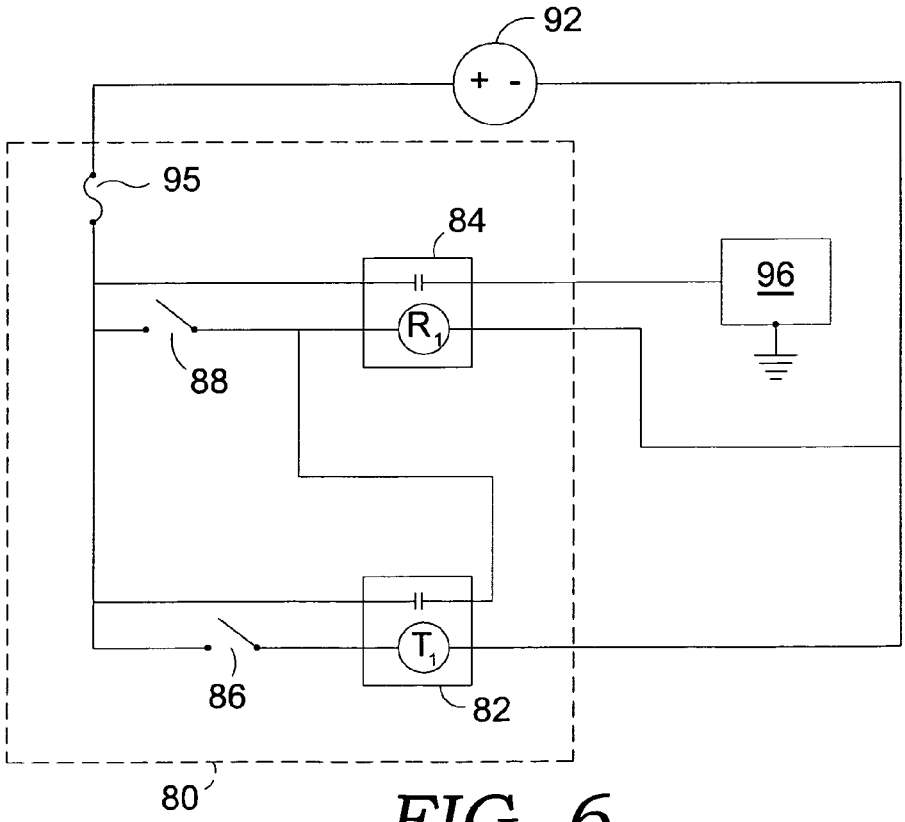
FIG. 6 is a schematic representation of the circuitry of the automated system of the present invention.

The SCD 76 may be seen in detail in FIGS. 5 and 6. Referring first to FIG. 5, SCD 76 contains a battery cable 78, a housing 80, a timer 82, a relay 84, a timer activation switch 86, a timer bypass or override switch 88, and a starter cable 90.

Cable 78 is a two-conductor electrical cord which is electrically connected at one end to the positive and negative terminals of the vehicle's battery 92 using connectors 77 and 79. Connectors 77 and 79 are conventional terminal clamps similar to those used at each end of a set of jumper cables. At its other end, cable 78 is physically and electrically coupled to one side of housing 80. Housing 80 physically contains the a electrical components necessary for automated procedure. These internally contained components will be discussed in detail below. Externally, however, an activation switch 86, a breaker reset 87, and a timer bypass (or override) switch 88 may be seen. Activation switch 86 turns on the timing components, enabling the user to accomplish automatic and repeated temporary activation of the engine. Breaker reset 87 is used to resume system continuity after a breaker has been thrown due to excessive amperage. Bypass switch 88 is used when the user decides to manually activate the vehicles starter without use of the timing components.

Extending out from the other side of the housing is a single-conductor starter cable 90. Cable 90 may be electrically and physically connected to the "S" terminal 75 on the starter solenoid 96 of the vehicle. A conventional gator clip 94 is provided on the end of the cable to make this connection.

A schematic disclosing the overall circuitry of the SCB 76, as well as the contents of housing 80, the showing the internal electrical components of the SCD 76 is shown in FIG. 6. Referring to the figure, battery 92 has positive and negative terminals. On the positive side of battery 92, a system breaker 95 is provided. Breaker 95 is tripped when the amperage through the system becomes too great. After this breaker has been tripped, it may be reset using reset switch 87 on the housing.

Also included in the circuit is a timer 84. Power to the timer is controlled using timer switch 86. Switch 86 is a simple on/off switch. When in "on" position, timer 82 will be activated to repeatedly bump the engine. Timer 82, in the preferred embodiment, is a repeat-cycle timer. Such timers are commercially available, and may be set to particular on-cycle and off-cycle durations. One example would be a model H3CR-F 12V-DC timer available from Omron, Inc., of Schaumburg, Ill. Other timers, however, will be known to those skilled in the art, and would fall within the scope of the present invention. Timer 82 enables the user to set timed set points—the delay between temporary activations (or bumps) of the engine. The timer also enables the user to set the precise length of the bump. Thus, timer set points are intervals created between the "bumps." Once the timer set points are created, activation of the timer 82 by timer activator switch 86 will cause the cycling to begin, and the engine will be bumped per the schedule set on the timer 82.

Timer 82 activates solenoid 96 with the assistance of relay 84. A relay is a simple electromechanical switch made up of an electromagnet and a set of contacts. The relay of the preferred embodiment is a 12V Automotive High Current Relay Model No. G8JR manufactured by Omron, Inc., of Schaumburg, Ill. Of course numerous similar relays are commercially available, any of which could be used and still fall within the scope of the invention. Relay 84 responds to signals from timer 82 to open a relay switch. This continuity releases a current to the starter solenoid 96, which in turn, activates the engine pistons so that the cleaner may be worked into all parts of the combustion chamber (including the upper parts) and the piston rings.

SCD 76 also includes a timer bypass switch 88. Switch 88 is a simple push button activated switch. In normal operation it will be hit and then released shortly thereafter. This is so the engine will turn over for only a short time. It allows the user to manually "bump" the engine manually after cleaning fluid has been administered into the combustion chambers of the engine. Referring to the schematic of FIG. 6, it may be seen that when bypass switch 88 is open, it allows current directly to the relay 84, which immediately activates starter 96. During the operation of the automated timing functions of the system, however, bypass switch 88 will be closed.

The procedures for cleaning a vehicles combustion chambers with the SCD are essentially the same as for the ignition-key activated procedures described in the earlier sections, except that the SCD eliminates the need for a technician to be available to periodically turn the ignition key. The SCD, instead, automates the bumping process. Additionally, the SCD eliminates the need to disable the ignition coils to prevent electrical damage to the ignition system—a step required in with the manual system This is because the SCD only activates the starter, and not the ignition system. With the manual turn-key technique, however, activation of the starter would also cause activation of the ignition system, unless the coils were disabled.

Otherwise, the automated procedures are the same. First, squid 10 is hung from the hood of the vehicle and filled with cleaner. Again, valves 42 are initially closed.

The SCD is then hooked up. Before connecting the SCD, the timer bypass switch 88 on the SCD housing 80 should be in the off position. To hook up the SCD, battery connectors 77 and 79 are clipped on to the vehicle's battery 92 as shown in FIG. 5. Next, gator clip 94 on starter cable 90 is attached to the "S" terminal post 75 on starter solenoid 96. The valves 42 on the squid are then opened to allow the cleaner fluid to enter the combustion chambers 64. Next, the timer bypass switch 88 is pressed to momentarily activate the engine's pistons. This should move the pistons only about two to three inches. This helps work the cleaner into the compression rings. Timer activation switch 86 on SCD housing 80 is then turned to the "ON" position. This activates the timer 82 and begins the periodic "bumping" process.

At the end of the first time period, timer activation switch 86 is turned to the "OFF" position and the blowing out process is followed. The blowing out process is accomplished by attaching a pressurized air source 28 onto snap-on connector 26. Engine 20 should then be turned over continuously for 30 to 60 seconds until the user observes the translucent tubes 52 reveal a complete absence of cleaner. This is done by simply holding down the bypass switch button 88 for the time necessary instead of turning the ignition key. Once tubes 52 are clear of cleaner, the user should continue turning the engine under pressure over for another 15 seconds. The pressure should be turned off, and the cleaner should now be substantially removed. The valves 42 that were opened should now be closed Once the blowing out process is complete, the same processes may be repeated as necessary to effectively clean the combustion chamber and rings.

Though the present invention has been described herein with reference to particular embodiments, a latitude of modification, various changes, and substitutions are intended in this disclosure, and it will be appreciated by one skilled in the art that in some instances some features of the invention will be employed without a corresponding use of other features without department from the scope of the invention as set forth in the following claims.

What is claimed is:

1. An apparatus for cleaning at least one combustion chamber on a vehicle using a cleaner, said vehicle also having a battery and a starter, comprising:

a power source electrically connected to a timer;

said timer electrically connected to said starter;

said timer intermittently activating the starter using power from said power source;

a body defining a cavity therein for receiving the cleaner; and at least one conduit having first and second ends wherein the first end is fluidly connected to a lower portion of the cavity and the second end is fluidly connectable to said at least one combustion chamber.

2. The apparatus of claim 1 wherein said at least one conduit is valved.

3. The apparatus of claim 1 wherein the second end of said at least one conduit is fluidly connectable to an adapter, the adapter being fluidly connectable to said at least one combustion chamber on said engine.

4. The apparatus of claim 3 wherein said at least one adapter is fluidly connectable to said at least one combustion chamber via an internal passageway.

5. The apparatus of claim 4 wherein the internal passageway is metered to control the rate of flow of cleaner back into the body.

6. The apparatus of claim 1, wherein said power source is the battery of the vehicle.

7. The appartus of claim 6 wherein the cleaner is a cleaning fluid, the combustion chamber of the vehicle having disposed therein the cleaning fluid.

8. A method of intermittently activating the engine of a vehicle, said vehicle including a battery, a starter, and a combustion chamber, said method comprising the steps of:

providing a power source;

providing a timer;

electrically connecting said power source to said timer;

electrically connecting said timer to said starter;

using said timer to intermittently activate said starter using power from said power source; and introducing cleaner to the combustion chamber before intermittently activating said starter.

9. A method cleaning the combustion chamber of an engine on a vehicle, said vehicle also including a battery and a starter, said method comprising the steps of:

providing a power source;

providing a timer;

electrically connecting said power source to said timer;

electrically connecting said timer to said starter; and providing a body defining a cavity therein;

fluidly connecting a first end of a conduit to a lower portion of the cavity and fluidly connecting a second end of said conduit to said combustion chamber;

delivering an amount of cleaner from said cavity of said body to said combustion chamber through said conduit; and using said timer to intermittently activate said starter.

* * * * *